US009743698B2

(12) United States Patent
Romm

(10) Patent No.: US 9,743,698 B2
(45) Date of Patent: Aug. 29, 2017

(54) MULTIPLE LAYER HAIR ENHANCEMENT, ADDITION, OR EXTENSION

(71) Applicant: Sherri Romm, Owings Mills, MD (US)

(72) Inventor: Sherri Romm, Owings Mills, MD (US)

( * ) Notice: Subject to any disclaimer, the term of this patent is extended or adjusted under 35 U.S.C. 154(b) by 239 days.

(21) Appl. No.: 14/704,415

(22) Filed: May 5, 2015

(65) Prior Publication Data

US 2015/0230532 A1 Aug. 20, 2015

Related U.S. Application Data

(63) Continuation-in-part of application No. 14/089,359, filed on Nov. 25, 2013, now Pat. No. 9,155,344.

(51) Int. Cl.
*A41G 5/00* (2006.01)

(52) U.S. Cl.
CPC ..... *A41G 5/004* (2013.01)

(58) Field of Classification Search
CPC ..... A41G 3/00; A41G 3/0041; A41G 3/005; A41G 3/0058; A41G 3/0066; A41G 3/0083; A41G 3/0091; A41G 5/00; A41G 5/0006; A41G 5/004
See application file for complete search history.

(56) References Cited

U.S. PATENT DOCUMENTS 3,485,249 A * 12/1969 Mast ..... A41G 3/00 132/53
2006/0081267 A1* 4/2006 Kuptiz ..... A41G 3/00 132/53
2008/0092913 A1* 4/2008 Sugai ..... A41G 3/0075 132/53
2009/0223543 A1* 9/2009 Herring ..... A23N 12/02 134/57 R
2009/0255547 A1* 10/2009 Starks ..... A41G 5/00 132/201
2010/0071714 A1* 3/2010 Sotokawa ..... A41G 3/0041 132/201

* cited by examiner

*Primary Examiner* — Rachel Steitz
(74) *Attorney, Agent, or Firm* — Ditthavong & Steiner, P.C.

(57) ABSTRACT

Hair enhancements, additions, and extensions that are, realistic, seamless, comfortable, secure, durable, and hygienic are disclosed. Embodiments include a hair product including a first layer, a second layer having an open weave structure, a third layer, the first and third layers encasing the second layer, and a plurality of strands of hair, each of the plurality of strands of hair being affixed to the second layer and extending therefrom. Other embodiments include a hair piece including a base comprising first, second, and third layers, the first and third layers at least partially encasing the second layer, and a plurality of strands of hair extending from the second layer. Various embodiments comprising different styles of hair enhancements are disclosed.

19 Claims, 15 Drawing Sheets

100

100

100

MULTIPLE LAYER HAIR ENHANCEMENT, ADDITION, OR EXTENSION

REFERENCE TO RELATED APPLICATION

This application is a continuation-in-part of U.S. patent application Ser. No. 14/089,359, entitled "MULTIPLE LAYER HAIR ENHANCEMENT, ADDITION, OR EXTENSION", filed on Nov. 25, 2013, the entire content of which is hereby incorporated by reference.

TECHNICAL FIELD

The present disclosure relates to a hair enhancement, addition, extension, and the like. The present disclosure is particularly applicable to hair pieces worn on the head (e.g., wig, toupee, etc.), and more particularly to hair pieces worn on top of a user's own (e.g., natural) hair.

BACKGROUND

The art of making hairpieces and wigs has been practiced for many years; however, these hairpieces may be designed for permanent, advanced male and female pattern baldness. Very little may have been designed to address site specific hair thinning and loss due to a myriad of both medical and non-medical factors. In addition, hairstyle versatility and effects (such bangs, wigs, volumizers, extensions, ponytails, etc) and reduced maintenance are in high global demand. Hairpieces and wigs on the market may offer fair to poor results for natural appearance, customization, integration with user's own hair, and simplicity of application by the user.

Hairpieces and wigs known in the art may lack a natural appearance, are prohibitively expensive, bulky, uncomfortable, hot, bumpy, ill-fitting, invasive, and may retard a user's own hair growth. Further, such hairpieces may: (1) be too heavy (too much hair) to disguise conventional bases; (2) limit or ignore the natural growth pattern of hair; (3) be synthetic or utilize poor quality human hair which does not mimic the qualities of real growing hair; (4) be unnatural in appearance; (5) be easily detectable; (6) fail to seamlessly integrate into a user's own hair; and (7) have poor or unrealistic front hairlines.

A need therefore exists for an improved hair piece, particularly, for hair enhancement, addition, or extension.

SUMMARY

An aspect of the present disclosure is a hair piece including, inter alia, a top layer, such as silk, e.g., fine nude color silk, a center layer, such as an open lace layer, e.g. of Swiss lace, and a bottom layer, such as silk, e.g., of fine pure organic silk.

Additional aspects and other features of the present disclosure will be set forth in the description which follows and in part will be apparent to those having ordinary skill in the art upon examination of the following or may be learned from the practice of the present disclosure. The advantages of the present disclosure may be realized and obtained as particularly pointed out in the appended claims.

According to the present disclosure, some technical effects may be achieved in part by a hair piece including: a first layer (e.g., fine nude color silk); a second layer (e.g., fine nude color open weave Swiss lace), the second layer having a folded perimeter; a third layer (e.g., fine nude color silk), the first and third layers, at least partially, encasing the second layer; an encasement layer (e.g., binding), such as a lightly coated silk ribbon surrounding edges of the first and third layers and extending therefrom, such as a distance of about ⅛ of an inch (3.175 millimeters) over outer surfaces of the first and third layers; a plurality of strands of hair, each of the plurality of strands of hair being affixed (e.g., by a double knot) to the second layer and having long and return ends protruding though the first layer; and (four) comb clips, e.g., having a medium nude color, each being affixed to an underside of the third layer.

Aspects include a hair piece, wherein the first, second, and third layers have one of the following shapes: a rectangular front portion having rounded corners and a round back portion; an oval; a rectangular front portion having rounded corners and a rectangular back portion having rounded corners; a circle; and a rectangular front portion having rounded corners and a hexagon back portion having rounded corners.

Additional aspects and technical effects of the present disclosure will become readily apparent to those skilled in the art from the following detailed description wherein embodiments of the present disclosure are described simply by way of illustration of the best mode contemplated to carry out the present disclosure. As will be realized, the present disclosure is capable of other and different embodiments, and its several details are capable of modifications in various obvious respects, all without departing from the present disclosure. Accordingly, the drawings and description are to be regarded as illustrative in nature, and not as restrictive.

BRIEF DESCRIPTION OF THE DRAWINGS

The present disclosure is illustrated by way of example, and not by way of limitation, in the figures of the accompanying drawing and in which like reference numerals refer to similar elements and in which.

DETAILED DESCRIPTION

Figure 1B:
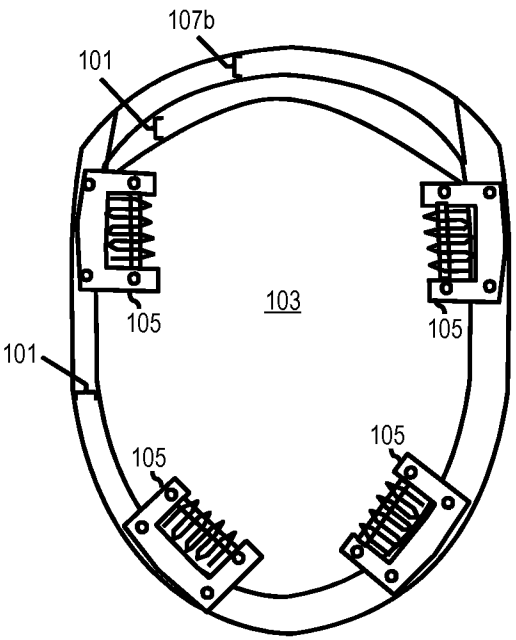
FIGS. 1A and 1B illustrate an underside/bottom view of hair pieces, in accordance with exemplary embodiments.

In the following description, for the purposes of explanation, numerous specific details are set forth in order to provide a thorough understanding of exemplary embodiments. It should be apparent, however, that exemplary embodiments may be practiced without these specific details or with an equivalent arrangement. In other instances, well-known structures and devices are shown in block diagram form in order to avoid unnecessarily obscuring exemplary embodiments. In addition, unless otherwise indicated, all numbers expressing quantities, ratios, and numerical properties of ingredients, reaction conditions, and so forth used in the specification and claims are to be understood as being modified in all instances by the term "about."

As used herein, hair piece includes hair products for hair enhancement, addition, extension, and the like. As such, hair pieces may be used in various medical and non-medical applications. By way of example, medical applications include men, women, children, with light, moderate, or advanced hair loss that is temporary or permanent. Such hair loss may include, for example, female pattern hair loss, male pattern hair loss, medications, early menopause (e.g., caused by cancer treatments), post pregnancy hair shedding, trichotillomania (e.g., hair pulling), alopecia areata, radiation, surgery causing temporary or permanent hair loss, cancerous moles, brain tumors, aneurysm, post hair transplantation, facelifts, injury to scalp, trauma or deformities, chemical burns, bad plugs and scars, traction alopecia, thyroid disease, telogen effluvium, dermatological (e.g., skin/scalp) diseases or conditions, protect from sun damage and environmental damage to scalp, and the like. Non-medical applications may include, for instance, cosmetic reasons to incorporate more hair. For example, to alter natural hair by modifying a volume, lift, fullness, length, color (e.g., color enhancement), (increase) styling versatility, and the like. Additionally, non-medical applications may include reducing styling 'prep' time, looking younger and more radiant, reducing a maintenance and cost associated with natural hair, raising self esteem, and socialability, and the like. Furthermore, many hair pieces are used for special occasions, such as weddings, proms, etc. It is contemplated that hair pieces may be utilized in various other applications, for instance, on animals (e.g., horses, dogs, etc.) or in fashion accessories.

As previously discussed, traditional hairpieces and wigs may lack a natural appearance, may be prohibitively expensive, bulky, uncomfortable, hot, bumpy, ill-fitting, invasive, and may retard a user's own hair growth. Further, such hairpieces may: (1) be too heavy (too much hair) to disguise conventional bases; (2) limit or ignore the natural growth pattern of hair; (3) be synthetic or utilize poor quality human hair which does not mimic the qualities of real growing hair; (4) be unnatural in appearance; (5) be easily detectable; (6) not integrate seamlessly into user's own hair; and (7) have poor or unrealistic front hairlines. Traditional methods of hair attachment may include bonding, taping, clipping, and weaving.

Bonding is generally for advanced and permanent thinning or balding. Users frequently have an entire area of "reconstruction" (e.g., area hair is to be added) to be shaved down completely or a 1" (2.54 centimeters) track shaved down on a user's own hair with hair being approximately ⅛" (3.2 millimeters) in length. Then either a silicone or cyclocyanoacrylate (e.g., superglue) based adhesive is commonly used to secure the hairpiece to the user's head. A hairpieces secured in such a manner usually stays on a user's scalp or hair up to about four weeks and sometimes less for users with an oily scalp or for very active users. User's frequently come back to a salon or hair replacement center to take off and reattach such a hairpiece as it either "grows off" or comes undone from the user's scalp. Dermatologically speaking, bacteria may easily grow and dermatitis can develop under unsanitary or overexposed conditions. In addition, over time the hair that has been shaved and subject to bonding adhesives can permanently damage hair follicles. Many users do not endorse this method as it forfeits natural growing hair that is shaved down. Additionally, bonding is frequently expensive in both budget and time. For instance, some bonding methods use between 4-6 hairpieces per year and users commonly return to a salon or hair replacement center monthly to have service performed. Frequently a user's vacations, traveling, and busy schedules cause potential scheduling challenges that can be exacerbated by high turnover in salons causing inconsistency and unpredictable results.

Taping is similar to bonding, in that it is generally used for advanced and permanent thinning or balding. Typically, any place where tape is used to secure a hairpiece is shaved. While commonly more hygienic than bonding adhesive, a user commonly takes off the hair piece either every day or every few days and reattach the hair piece themselves. Some users do not like this option as it requires shaving their hair down and accurately placing and securing hair piece down themselves. Similar to bonding, because taping forfeits natural growing hair that is shaved down, many users do not endorse this method. For instance, many users do not want to look at themselves without hair nor want their spouses knowing their hair issues.

Clipping is generally cleaner and more hygienic than bonding and taping, but frequently requires user intervention on a daily basis. Additionally, users commonly have a short learning curve to develop dexterity for securing and placing a hairpiece properly on their head. Clipping attachments may provide user independence and protect integrity of a user's own head unless the hairpiece is improperly designed, too heavy, or improperly handled by the user. Traditional hair pieces that are clipped on are frequently heavy, one size fits all, have too much hair and coverage, or are complicated in their integration of existing hair. In addition, many of such hair piece do not appear natural and are covered, resulting in a look that is unnatural (e.g., no scalp shown), a forced hair direction, an inability to style freely, and a heavy hair piece.

Weaving generally involves hair wefts or small bundles of hair woven, braided, glued or sewn onto natural hair to add bilk or nodules. However, weaving frequently complicates hair care protocol and may result in excessive stress on natural hair that it's bonded. For instance, extensions, weaves, and the like hanging on hair frequently causes damage over time and may not rebound. Frequently, weight from extensions pulls on a person's natural hair over time, causing it to rip out natural hair by the root. Furthermore, natural hair follicles can be damaged or destroyed using weaving, in some cases, permanently. Additionally, weaving may also require constant maintenance and dependency on a hair weaver.

As illustrated above, many users, particularly users with temporary or permanent hair loss, could benefit from a hair piece that (1) omits unnecessarily shaving natural hair; (2) uses no harmful adhesives or injuring attachments; (3) has a low cost on time, money, and emotional energy; and (4) does not create a financial, lifelong, or dependent situation where a user is dependent on hair replacement companies and technicians.

As such, there is a need for a hair enhancement/addition/extension that is, realistic, seamless, comfortable, secure, durable, hygienic, provides coverage or volume (not in excess), and protects the integrity of a users own natural hair.

The present disclosure addresses and solves such problems. In accordance with embodiments of the present disclosure, the problems are solved, for instance by, inter alia, encapsulating a lace layer with a top and bottom layer.

Still other aspects, features, and technical effects will be readily apparent to those skilled in this art from the following detailed description, wherein preferred embodiments are shown and described, simply by way of illustration of the best mode contemplated. The disclosure is capable of other and different embodiments, and its several details are capable of modifications in various obvious respects. Accordingly, the drawings and description are to be regarded as illustrative in nature, and not as restrictive.

Figure 1A:
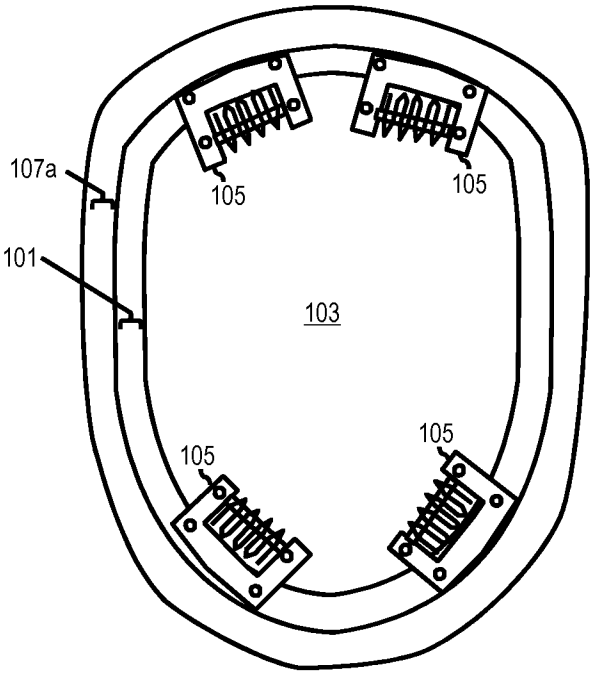

Adverting to FIGS. 1A and 1B, hair piece 100 includes an encasement layer 101, a tri-level virtual scalp 103, and comb clips 105. As shown, the encasement layer (e.g., binding) 101 is ⅛ inch (3.175 millimeters) and is a lightly coated silk ribbon (e.g., frame). The encasement layer 101 is stitched to surround and encase edges of the tri-level virtual scalp 103 as further described with respect to FIG. 2. The encasement layer 101 may have a range of 1/32 of an inch (0.79 millimeters) to ½ of an inch (12.7 millimeters). The encasement layer 101 may be formed of at least one of fine silk, nylon, polyester, TENCEL, milkweed seed-pod fibers, silk-cotton tree filaments, rayon, and ahimsa silk and have a thickness of 3 mommes to 15 mommes.

Additionally, as shown, comb clips 105 are medium nude color comb clips positioned with two comb clips 105 on a front portion and two comb clips 105 on a back portion of hair piece 100. The comb clips 105 may be sewn in to the hair piece 100, for instance, along a stitching to attach the encasement layer 101 and used to attach the hair piece to, for example, natural hair of a user's head. The comb clips 105 may be formed of metal, plastic, and the like, and may be painted, for instance, to match a color of the tri-level scalp 103. It is noted that comb clips 105 may be changed and arranged to suite different needs. For instance, fewer (e.g., 1, 2, 3) or more (e.g., 5, 6, 7, etc.) comb clips 105 may be used. Additionally, or alternatively, comb clips 105 may be positioned at different positions (e.g., along the outer perimeter, in different positions outside the outer perimeter, etc.) and at different orientations (e.g., with comb teeth facing in various directions).

Further, an extension 107 may be added depending on a design specification. For instance, FIG. 1A illustrates a full perimeter Swiss lace extension 107*a* and FIG. 1B illustrates a frontal perimeter Swiss lace extension 107*b*. The extensions 107*a* and/or 107*b* may extend from the encasement layer 101 a distance of, for instance, ⅛ of an inch (3.175 millimeters) to ¼ of an inch (6.35 millimeters).

Figure 2:
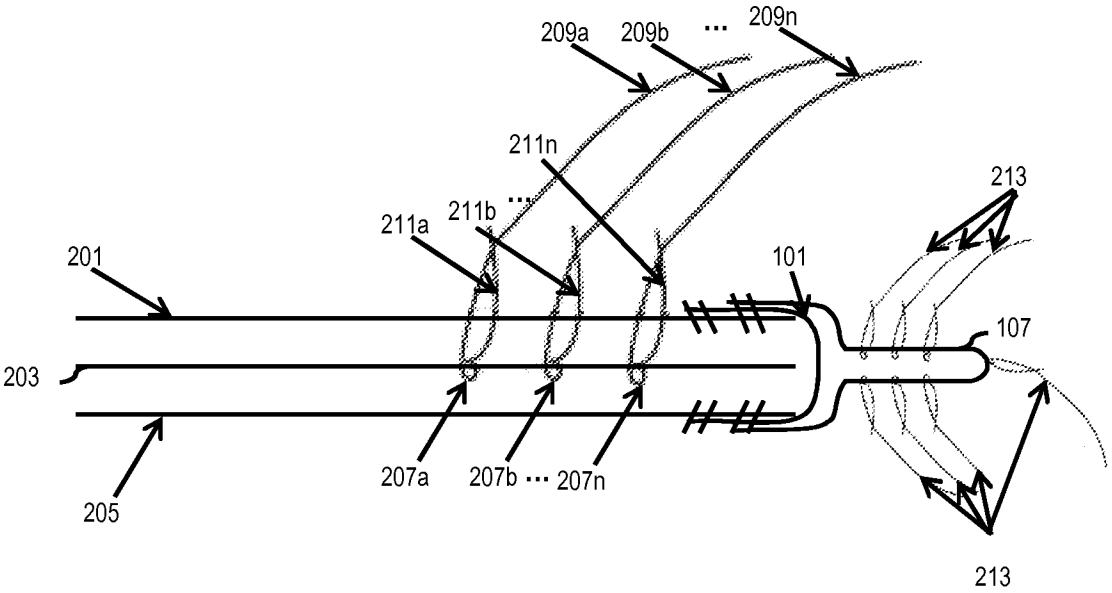
FIG. 2 illustrates a side view of a hair piece, in accordance with an exemplary embodiment.

Adverting to FIG. 2, the hair piece 100 includes a top layer 201, a center layer 203, and an under layer 205. As shown, each of the hair strands 207 are double knotted to center layer 203 and have a long 209 and return end 211 over vented through the top layer 201. Additionally, each of the hair strands 207 may be knotted separately from the other hair strands 207 (e.g., single hair—double knot).

The top layer 201 may be formed, for instance, of fine pure organic silk having a nude and/or scalp color. As such, the top layer 201 may be selected to resemble a realistic scalp color of a user, to hide a user's own hair color (which may be particularly important when worn on the head), and to have no reflective qualities adding to a user's natural appearance (e.g., not shiny or artificial in appearance). The top layer 201 may be formed of other suitable silk-like materials, such as, for example, nylon, polyester, TENCEL, milkweed seed-pod fibers, silk-cotton tree filaments, rayon, and ahimsa silk.

Furthermore, the material of the top layer 201 may facilitate a flow of moisture away through evaporation and exude harmful elements with perspiration. For instance, fine pure organic silk may be selected as silk may retain up to 30% of its own weight in moisture without feeling wet. A weave of the top layer 201 may be tight enough to secure hair in a position. Hair strands 207 may be vented up one hair at a time through the top layer 201, for instance, mimicking natural hair from a scalp. The top layer 201 may be configured allow easy styling and/or a unidirectional placement of hair strands 207 as well as to protect center layer 203 by providing a top enclosure. Further the top layer 201 may minimize excessive wear and loss of hair by protecting center layer 203 from exposure. It is noted that silk or a silk-like material may be used in top layer 201 to keep a form of a design that is flexible and does not shrink when wet (e.g., pre-shrunk).

The center layer 203 may be formed, for example, of fine nude color Swiss lace, super fine Swiss lace, French lace, and the like. Additionally, the center layer 203 may be selected to be lightweight, flexible, thin, fine, sturdy, open, breathable, and the like. Furthermore, the center layer 203 may be configured to have an open weave to enable a unidirectional ventilation to mimic natural hair and to allow a custom hair part. Single hair strands 207 may be double knotted onto center layer 203 to provide a realistic appearance and high durability (e.g., durable ventilation). The center layer 203 may comprise of 30 to 90 holes per square inch or about 55 holes per square inch to allow simplified control of density of hair for a natural appearance. Additionally, the center layer 203 may allow for easy reventing of hair strands 207 and to add hair for a refurbishing of the hairpiece 100. The center layer 203 may be configured to use lace that does not shrink when wet (e.g., preshrunk) that has a nude color to resemble a natural scalp and that is comfortable, particularly when worn for long periods on the head. In some embodiments, the center layer 203 is folded along an outer perimeter.

The under layer 205 may be formed, for example, of fine pure organic silk having a nude and/or scalp color. The under layer 205 may be formed of other suitable silk-like materials, such as, for example, nylon, polyester, TENCEL, milkweed seed-pod fibers, silk-cotton tree filaments, rayon, and ahimsa silk. The under layer 205 may be selected of an organic material. Additionally, the under layer 205 may be used to create a soft barrier that does not put stress on a user's hair and/or scalp and does not feel abrasive. The under layer 205 may resemble natural scalp color and hide a natural hair color of a user, which is particularly important when sitting on top of a user's hair and/or scalp. The material of under layer 205 may be thin e.g., 3 mommes to 15 mommes or 3 mommes to 8 mommes to enable the under layer 205 to be lightweight and breathable. The under layer 205 may be formed of a high density material (e.g., silk) that affords extra soft, pliable fabric that is comfortable and cosmetically pleasing. Additionally, the under layer 205 may be eco-friendly (e.g., organic) and not dyed. Furthermore, use of silk in the under layer 205 facilitates a flow of moisture away through evaporation and exudes harmful elements with perspiration as silk may retain up to 30% of its own weight in moisture without feeling wet. It is noted that silk may be used in under layer 205 to keep a form of a design that is flexible and does not shrink when wet (e.g., pre-shrunk).

As shown, the extension 107 is folded. The extension 107 may be added after the encapsulating of the center layer 203 by the layers 201 and 205 and the forming of the encasement layer 101. Additionally, hair strands 213 may be vented on a top portion, side portion, under portion, or a combination thereof of the extension 107 and affixed to the extension 107 using a (double) knot holding a single hair strand. The venting of hair strands 213 may substantially cover the extension 107 to hide extension 107. In some embodiments, hair strands 213 are each affixed by hand to the extension 107. Moreover, knots of hair strands 213 may be bleached (not shown) and further cosmetically enhanced, for instance, using a chiaroscuro coloring method described below. The extension 107 may be formed, for example, of fine nude color Swiss lace, super fine Swiss lace, French lace, and the like. The extension 107 may comprise of 30 to 90 holes per square inch or about 55 holes per square inch to allow simplified control of density of hair for a natural appearance. As shown, the extension 107 is stitched to layers 201-205 and encasement layer 101. It is noted that extension 107 may be attached to the layers 201-205 by using an adhesive. Additionally, extension 107 may extend on only a portion of the perimeter of the layers 201-205, for instance, in a front portion as shown in FIG. 1A.

The hair strands 207 and/or 213 may (e.g., long end 209 and/or return end 211) may be further enhanced, for example, using a chiaroscuro color method. Chiaroscuro, for example, refers to a method to create form, volume, and 3-dimensional effect using strong contrasting between light and dark (and also warm and cool colors). Such a method may be used to replicate a user's own growing hair to make hair enhancement (e.g., use of a hair piece) undetectable and seamless. Further, such a method in which each enhancer is colored using a systematic approach may be performed at various times, for instance, during a manufacturing of a hair piece at a factory, during a fitting at a studio, etc.

In one embodiment, a Chiaroscuro color method includes a range of three to five colors selected for color theme palette that represent user's natural color, such as, for example, a base (e.g., midtone), a highlight (e.g., lights reflected), and lowlights/root color (e.g., shadowing). By way of example, if a user has natural hair having a level 5 warm, a level 4 warm color is selected for roots of hair strands 207 and lowlight, a level 5 is selected for midrange of hair strands 207, and a level 7+ is selected for highlights of hair strands 207. In some embodiments, a "root/shadow" color is the darkest color. For example, if "root" color is chosen, the length of root/shadow color of hair strands 207 may be selected to extend from the root base (enters the silk top) a distance to appear as a gradual transition appearing natural, thereby avoiding an apparent abrupt change. For example, the length of root/shadow color of hair strands 207 may extend from the root base to about ⅝ of an inch or approximately ½ inch to ¾ inch (12.7 millimeters to 19.05 millimeters) in an organic seamless means.

For custom colorations, the "root" color may be hand painted on an entire root area (where the hair comes out of the virtual scalp) of hair strands 207 using a color brush and fanning technique to create a seamless graduation of the root color into other colors. For the underside towards the back and sometime sides of a hair piece 100, a root color of hair strands 207 may be used and taken longer to resemble a natural gradation from light in the front/top to darker under the crown to the nape and temporal area (e.g., side of head behind the ears). In some embodiments, a root color of hair strands 207 progressively gets longer going toward the back crown and nape as to transition into darker areas on a user. This enables a seamless transition into user's hair.

Additional highlights may be hand painted on hair strands 207 to break up any delineation of a root color applied and to increase a percentage in a face framing and top surface layer to mimic a sunkisted look. It is noted that there are exceptions for those who are bold with color. Additionally, some embodiments follow a user's own hair as guide to color hair strands 207.

Further, human gray variations (e.g., 100") may not have roots applied to hair strands 207. Additionally, ends of hair strands 207 may be oxidized using a mild bleaching balayage or flamboyage (French lacing) method. As such, color results end in a hair enhancement that is natural and is "grounded" in a user's natural hair and coloration to seamlessly transition into a user's natural hair. It is noted that the various examples using hair strands 207 may be applicable to hair strands 213.

Figure 3:
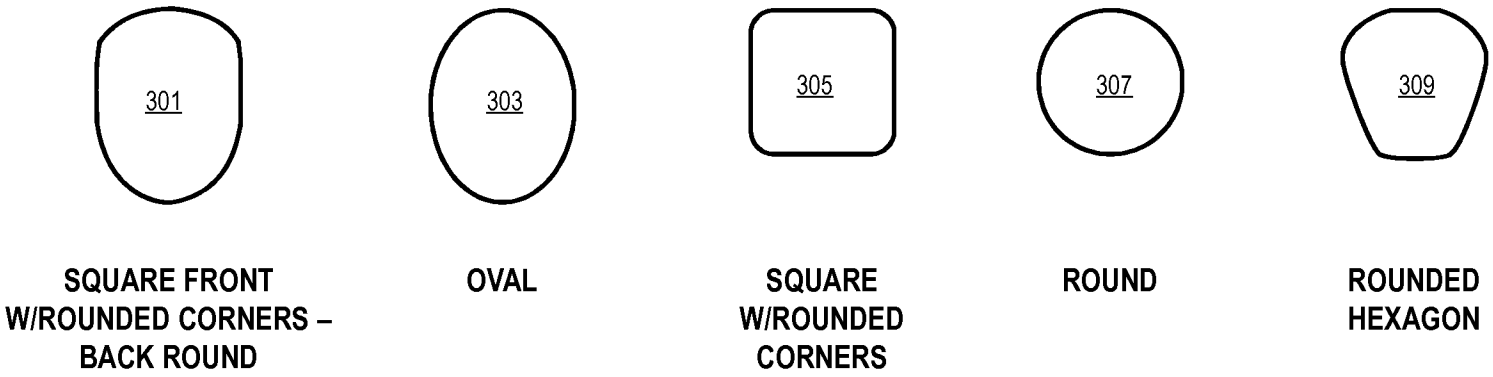
FIG. 3 illustrates a top view of various shapes of hair pieces, according to various exemplary embodiments.

Adverting to FIG. 3, an aerial view of base shapes of hairpieces (e.g., 100) is illustrated. As shown, hair piece 301 has a square front with rounded corners and a round back, hair piece 303 has a oval shape, hair piece 305 is a square (or rectangular) shape with rounded corners, hair piece 307 is a round (or oval shape) and hair piece 309 is a rounded hexagon. It is contemplated that shapes of hair pieces 301-309 may be substituted for the shape of hairpiece 100.

The hair piece 301 may have a soft "C" front with rounded corners back. Additionally, the hair piece 301 may have a shape that provides exceptional coverage of temple recession, bangs, crown, soft shapes transition to surrounding hair. Further the hair piece 301 may be worn in front of or set just behind a front hairline and may also provide mid to crown coverage.

The hair piece 303 may provide center coverage for general thinning in a center portion and/or parting depending on hair loss area and/or volume desired. The hair piece 303 may be selected, for example, to address a minor hair loss and/or improve volume. Additionally, the hair piece 303 may be selected, for instance, for users with rounded features and oval shape head.

The hair piece 305 may provide center coverage for thinning in a center portion and/or parting depending on hair loss area or volume desired. The hair piece 303 may be selected, for example, to address a mid to back/crown recession or crown separation. Additionally, the hair piece 305 may be used for spot coverage and/or for moderate loss or volume.

The hair piece 307 may provide crown and/or spot coverage, to improve volume, for spot coverage in case of scarring, alopecia, radiation, trichotillomania, for specific localized area of loss, and the like.

The hair piece 309 may, for instance, provide frontal coverage for deep frontal recession, bangs, temporary or permanent loss from facelifts, hair transplantation, and provide integration and smooth transition into own part/hair.

Figure 4:
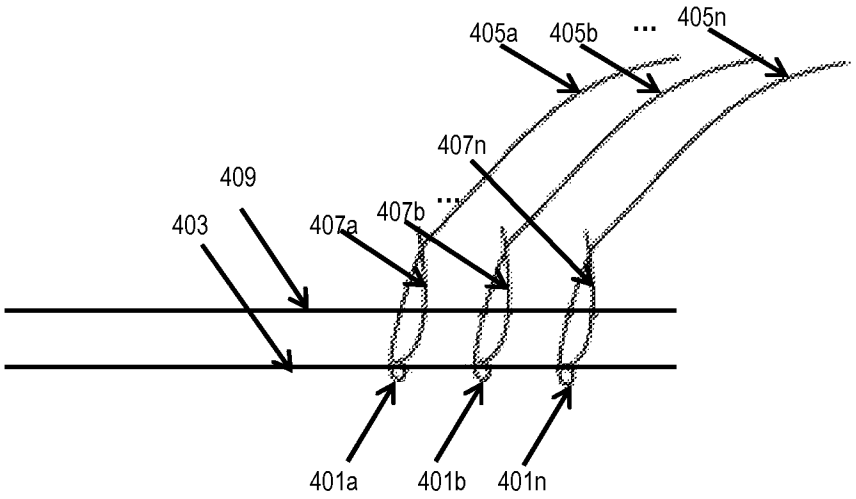
FIGS. 4 through 7 illustrate a method for manufacturing a hair piece, in accordance with an exemplary embodiment.

FIGS. 4 through 7 illustrate a method for manufacturing a hair piece, in accordance with an exemplary embodiment. As shown in FIG. 4, hair strands 401 are attached (e.g., single hair—double knot) to center layer 403 and each long 405 and return end 407 of each of the hair strands 401 is vented up (e.g., one hair at a time) through a top layer 409.

Figure 5:
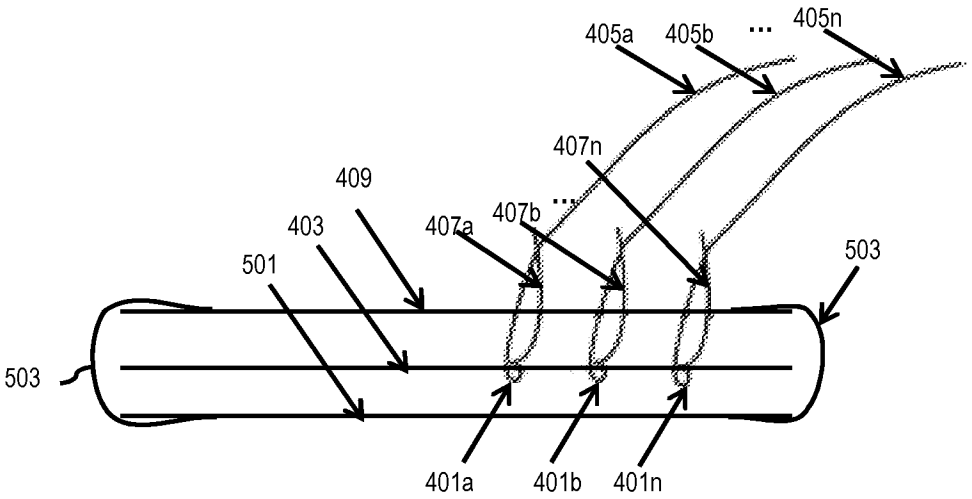

As shown in FIG. 5, an under layer 501 is positioned under the center layer 403 and an encasement layer 503 is placed over a top surface of the top layer 409 and over a bottom surface of the under layer 501. As illustrate, center, top, and under layers 403, 409, 501, respectively, are stacked having outer edges aligned.

Figure 6:
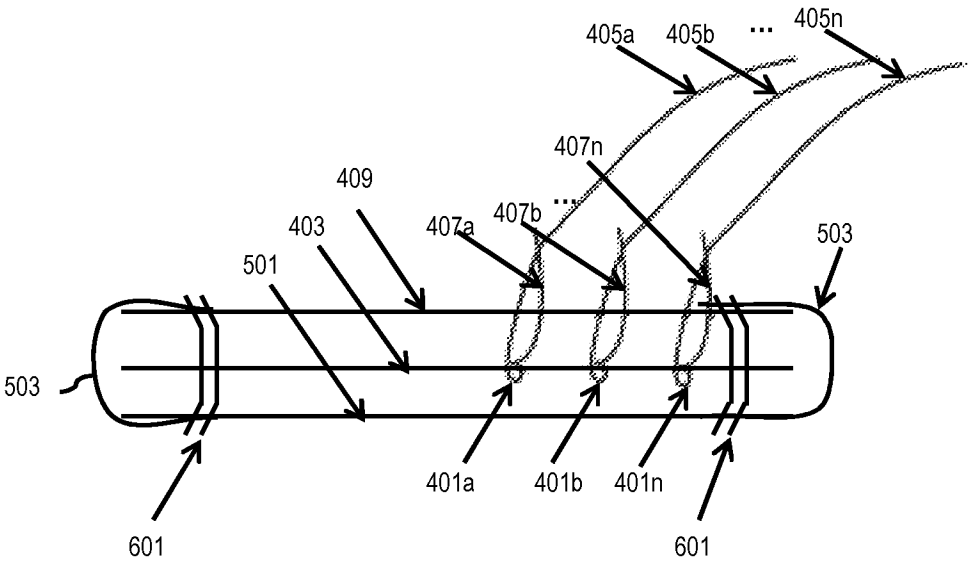

As shown in FIG. 6, stitches 601 are stitched through the encasement layer 503 and through the center, top, and under layers 403, 409, 501, respectively, to hold and protect the center layer 403 and to protect knots of hair strands 401. As shown, the stitches 601 are placed ⅛ inch (3.175 millimeters) from outer edges of the center, top, and under layers 403, 409, 501, respectively, resulting in an overlap of the encasement layer 503 over a top surface of the top layer 409 and over a bottom surface of the under layer 501. It is contemplated that the stitches 601 may be placed in a range of 1/32 of an inch (0.79 millimeters) to 1/2 of an inch (12.7 millimeters) from outer edges of the center, top, and under layers 403, 409, 501, respectively.

Figure 7:
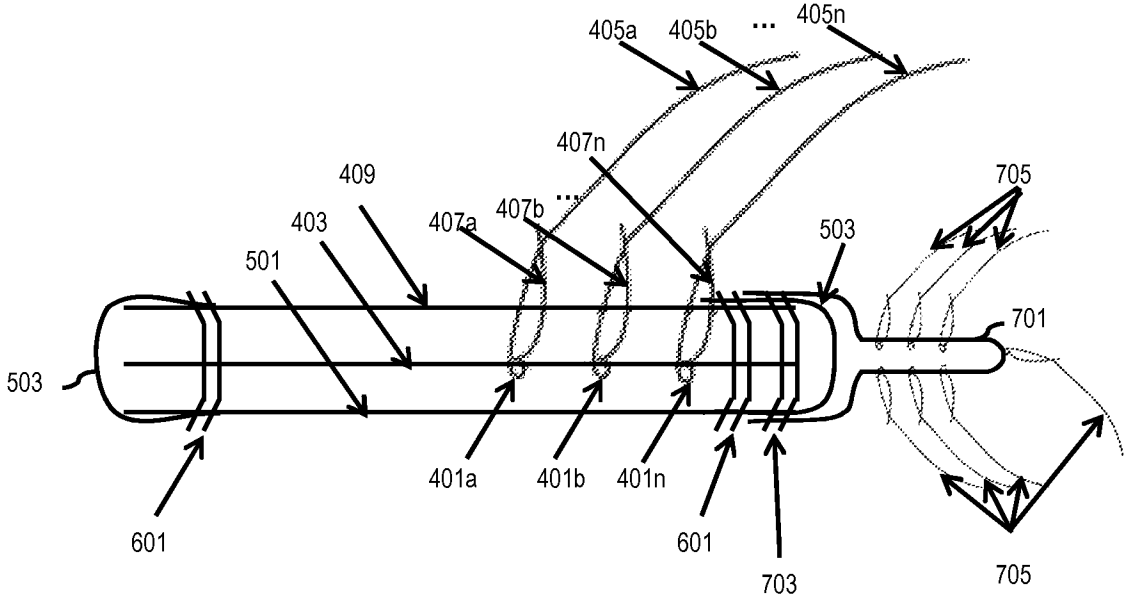

In FIG. 7, an extension lace 701 is placed on the encasement layer 503 and an outer edge of the center, top, and under layers 403, 409, 501, respectively. As shown, the extension lace 701 is placed over a portion (e.g., front half as shown in FIG. 1B) of the encasement layer 503. It is noted that the extension lace 701 may be omitted, placed over an entirety of the encasement layer 503, and placed over other portions of the encasement layer 503, such as, for instance, front and side portions, etc. Stitches 703 are stitched through the encasement layer 503 and through the center, top, and under layers 403, 409, 501 to hold the extension lace 701. As shown, the stitches 703 are placed 1/16 inch (1.58 millimeters) from outer edges of the center, top, and under layers 403, 409, 501. As shown, hair strands 705 are (double) knotted and over, under, and side vented (e.g., one hair at a time) to the extension lace 701. The knots may be bleached (not shown) and further enhanced, for instance, using the chiaroscuro coloring method described above. Additionally, comb clips (e.g., 105) may be added (not shown).

Figure 8A:
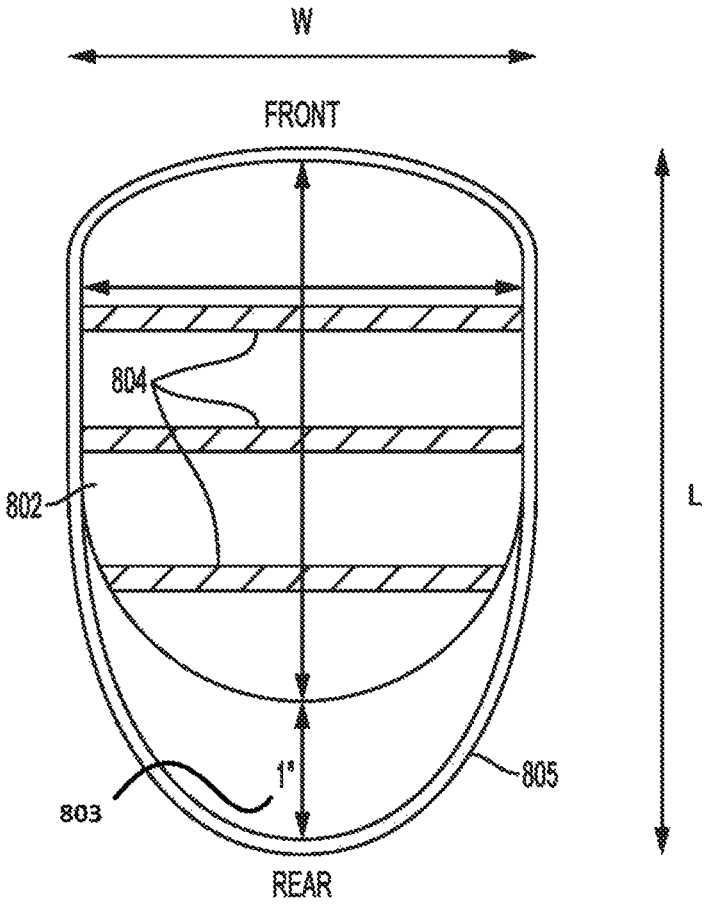
FIGS. 8A, 8B, and 8C illustrate top views of particular types of a hair piece style in accordance with aspects of the present disclosure.

Adverting to FIG. 8A, one particular example of a hair piece, manufactured in a manner similar to the previously described embodiments, may be identified, for example, as a "French Flash." This particular hair piece style may be employed, for example, in situations where a user has thinning portions of hair on selected portions of their head, and may be employed, for example, for partial and/or top and/or crown coverage. This style of hair piece may provide for bang and crown coverage, depending on the size of the hair piece.

The hair piece of FIG. 8A illustrates a top-view of the hair piece having a width dimension W, which may be in the range of 2.5 to 4.5 inches, such as 3.5 inches, and a length dimension, L, which may be in the range of 4 inches to 6.5 inches, such as 5.25 inches. The front of the hair piece is illustrated in the top portion of the drawing and the rear portion of the hair piece is illustrated in the bottom portion of the drawing.

The hair piece of FIG. 8A is formed with a base portion 802 and an extended portion 803, and is designed to have a shape which reflects the natural curve of the top of a user's head. The underside of the base portion 802 comprises a plurality of anti-slip strips 804 designed to resist slippage of the hair piece from the head of a user when worn. It should be understood that while the anti-slip strips are illustrated in the drawing for clarity, the strips would be hidden from view in the top view illustrated in FIG. 8A (and in FIGS. 8B and 8C, described below). While the number of anti-slip strips may vary, such as at least three such strips, having a strip in at least a front portion, a middle portion, and a rear portion of the base portion 802 of the hair piece. The distal end of the rear portion of the hair piece is separated from, and lies about 1 inch from, the distal end of the rear portion of the base portion 802.

Although the exact dimensions and material may vary, the hair piece of FIG. 8A may be made with a 0.125 inch folded Swiss lace perimeter 805. The Swiss lace perimeter acts to create a natural hairline and is heavily undervented to camouflage the edge at a hairline while, at the same time, increasing durability.

Figure 8B:
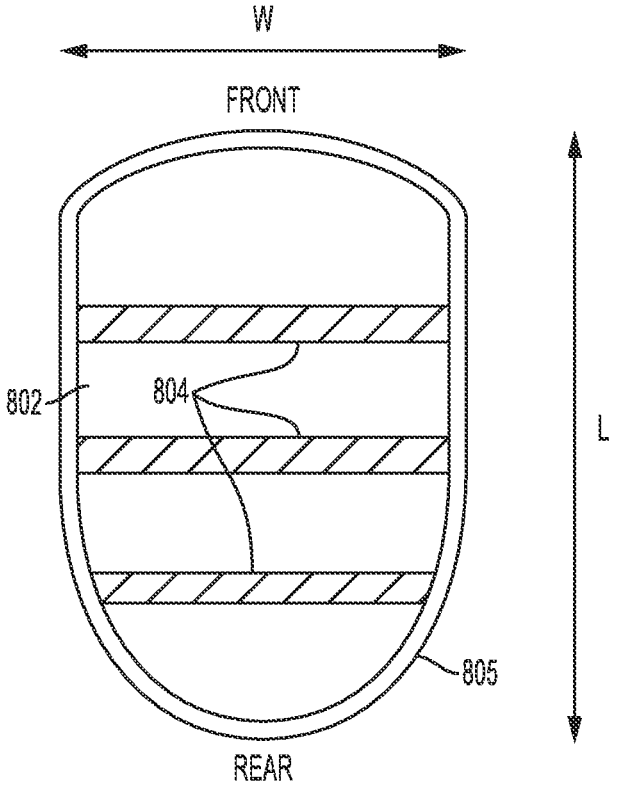

Adverting to FIG. 8B, a hair piece is illustrated as a smaller version of the hair piece of FIG. 8A, and may be identified, for example, as a "Petite French Flash." In the smaller version, as in the hairpiece of FIG. 8A, there is a perimeter 805, for example made of 0.125 inch folded Swiss lace, and there are a plurality of anti-slip strips 804 on the underside of the hair piece to prevent slippage. However, in the smaller version, the width and length dimensions are smaller than in the hair piece of FIG. 8A. For example, the width W of the hair piece of FIG. 8B is about 0.5 inches less than the width of the hair piece of FIG. 8A and the length L is about 1 inch less than the length of the hair piece of FIG. 8A. The width of the smaller version of FIG. 8B may be about 3 inches and the length may be about 4.5 inches. Notably, the smaller version does not have an extension portion as in the hair piece of FIG. 8A.

The smaller version of the "French Flash" style illustrated in FIG. 8B has special application where, for example, the user has thinning hair that needs to be covered in a smaller, less extensive, area. Thus, the smaller version of the hair piece illustrated in FIG. 8B may be employed in situations having a smaller area of coverage.

Figure 8C:
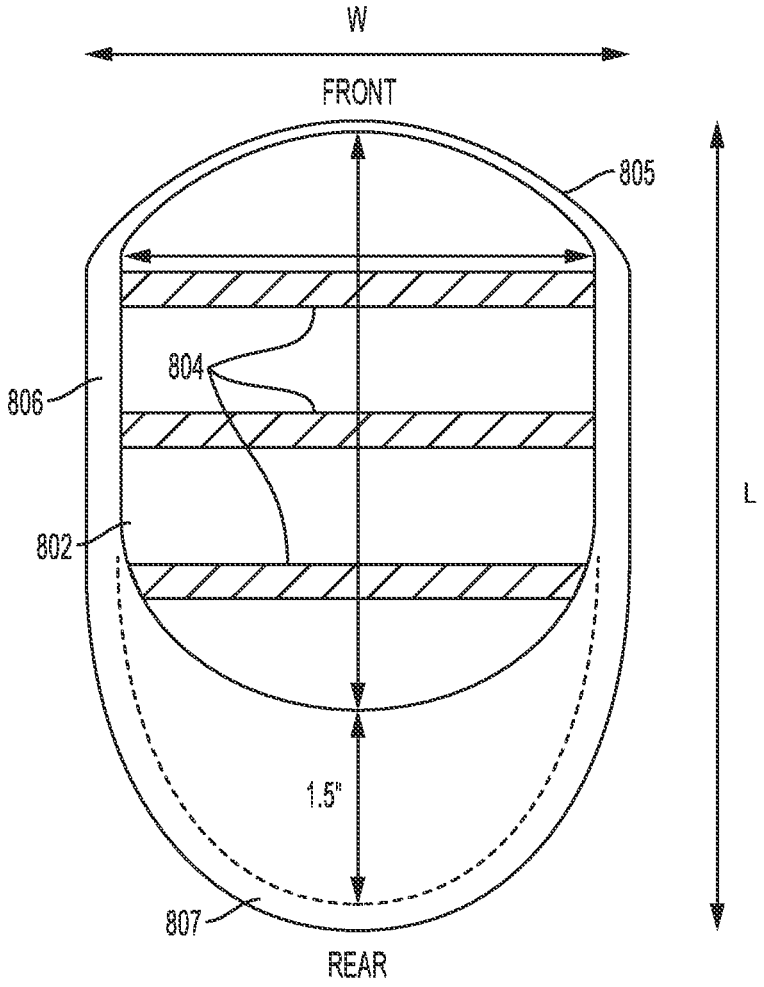

Adverting to FIG. 8C, a hair piece is illustrated as an expanded, or larger, version of the hair piece of FIG. 8A, and may be identified, for example, as a "French Flash Grande." In this version, as in the hairpiece of FIG. 8A, there is a perimeter 805 that may be made of 0.125 inch folded Swiss lace. However, that perimeter of Swiss lace only extends along the front portion of the hair piece, as illustrated. The remainder of the perimeter, as shown by the dotted line down the sides of the hair piece and along the rear portion of the hair piece, may be made of 0.25 inch folded Swiss lace. As in the previously described versions, there is a plurality of anti-slip strips 804 on the underside of the base portion 802 of the hair piece to prevent slippage. However, in the expanded version illustrated in FIG. 8C, the width and length dimensions are larger than those of the hair piece of FIG. 8A. While the dimensions may vary, the width W of the hair piece of FIG. 8C may be about 4 inches and the length L may be about 6 inches.

The expanded version of the "French Flash" depicted in FIG. 8C would be employed, for example, where a larger area of coverage is desired, as where, for example, a user may have a larger head and/or a more extensive area of thinning hair that must be covered.

Figure 9A:
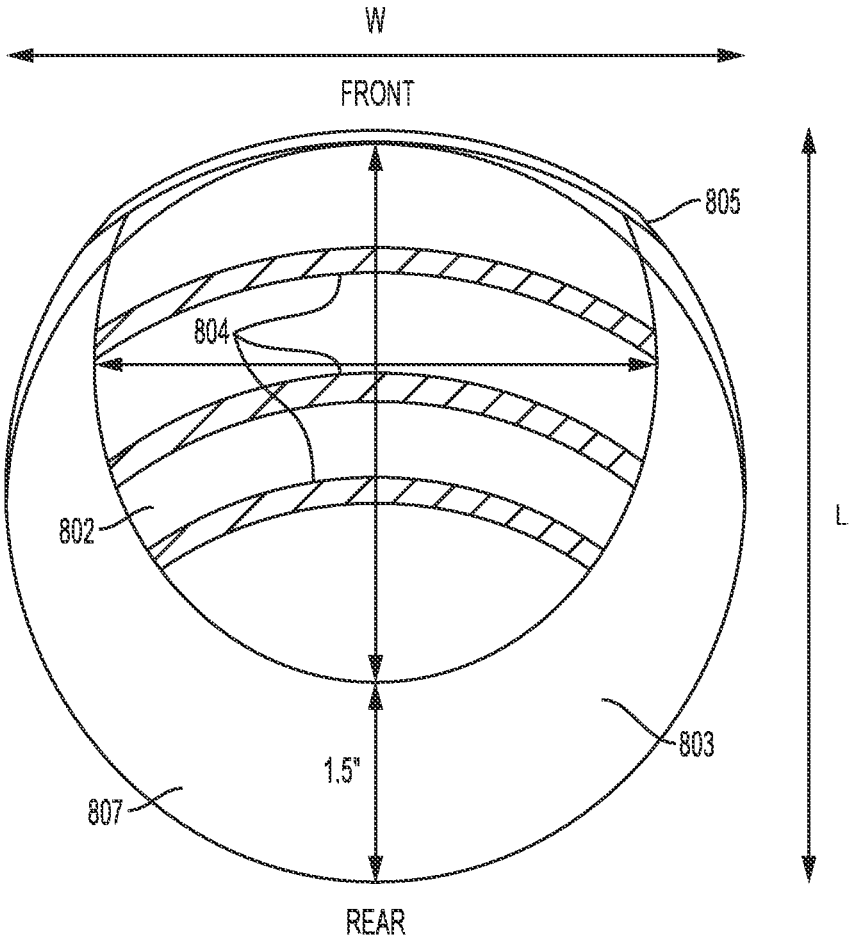
FIGS. 9A and 9B illustrate particular types of another hair piece style in accordance with aspects of the present disclosure.

Adverting to FIG. 9A, a hair piece, manufactured in a manner similar to the previously described embodiments, is illustrated and may be identified, for example, as a "French Flash Fall." This particular hair piece style may be employed, for example, in situations where a user desires volume, lift, fullness, length, and color enhancement between color services, with reduced styling and preparation time.

The "French Flash Fall" style of FIG. 9A is a fuller, more round enhancement than the "French Flash" hair pieces of FIGS. 8A, 8B, and 8C. In fact, the shape of this hair piece approaches that of a circle in that the longest length L and the longest width W are fairly close. For example, the overall length is about 5.675 inches while the overall width is about 5.5 inches. The hair piece in the "French Flash Fall" style comprises a base portion 802 and an extended portion 803. In an aspect of the present invention, the longest length dimension of the base portion 802 may be about 4 inches and the length of the extended portion 803 from the distal end of the rear-most point of the base portion 802 to the distal end of the rear-most portion of the extended portion may be about 1.5 inches. As in the previous styles, the "French Flash Fall" style of FIG. 9A comprises a plurality of anti-slip strips, e.g., three, but the number may vary, on the underside of the base portion 802. Again, these anti-slip strips are shown in the drawing for clarity, but, in reality, since this is a top-view of the hair piece, the strips would not be seen.

As in the previously described styles, the shape of the "French Flash Fall" style is designed to have a soft curvature to closely fit the head of a user. Preferably, the shape should not be flat so as to give an appearance of some lift in the hair piece.

The base portion 802 of the "French Flash Fall" style of FIG. 9A may have a substantially equal length and width, e.g., about 4 inches. The entire hair piece may comprise a layer of Swiss lace, e.g., 0.25 inch folded and stitched along most of the perimeter of the hairpiece, with a layer of lace, e.g., about 0.125 inch folded along the front of the hair piece.

Figure 9B:
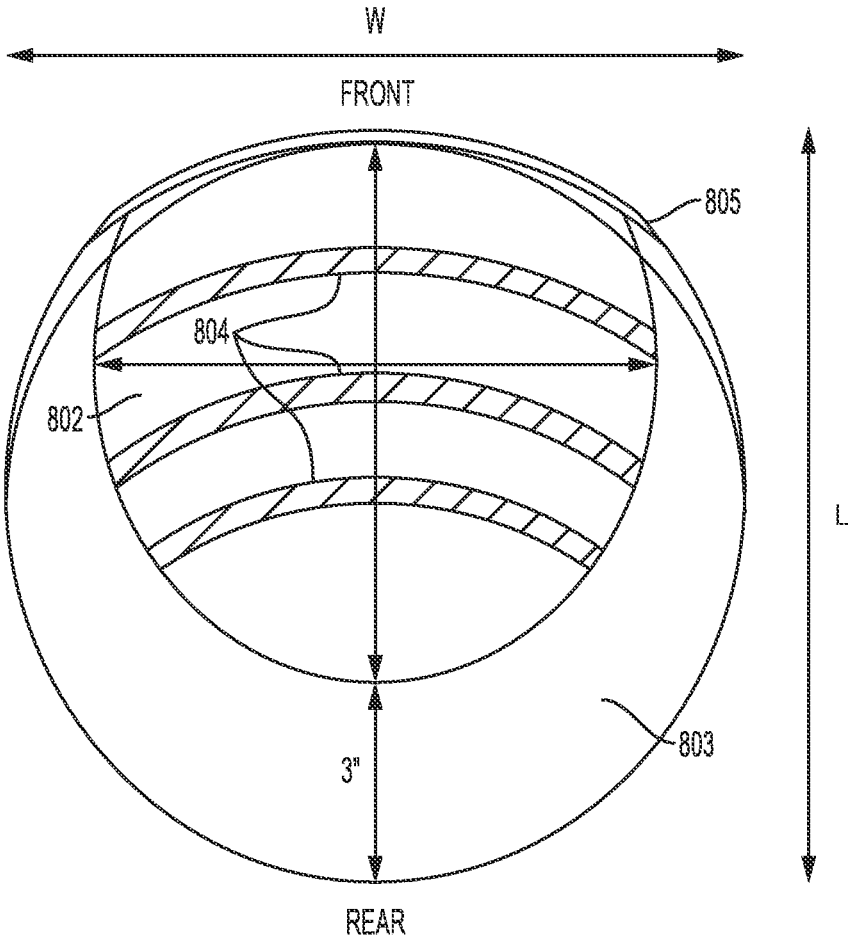

Adverting to FIG. 9B, a hair piece is illustrated as an expanded, or larger, version of the "French Flash Fall" hairpiece of FIG. 9A, and may be identified, for example, as a "French Flash Fall Grande." In this version, as in the hairpiece of FIG. 9A, there is a perimeter 805 that may be made of 0.125 inch folded Swiss lace. However, that perimeter of Swiss lace only extends along the front portion of the hair piece, as illustrated. The remainder of the perimeter along the rear portion of the hair piece, may be made of 0.25 inch folded Swiss lace. As in the previously described versions, there is a plurality of anti-slip strips 804 on the underside of the base portion 802 of the hair piece to prevent slippage. However, in the expanded version illustrated in FIG. 9B, the width and length dimensions are larger than those of the hair piece of FIG. 9A. While the dimensions may vary, the width W of the hair piece of FIG. 9B may be about 7 inches and the length L may be about 8.125 inches. The base portion 802 may have a length of about 5 inches and a width of about 4.25 inches. The base portion 802 may be made of silk, e.g., French silk. The extended portion 803 in FIG. 9B is larger than the extended portion illustrated in FIG. 9A, and the length of the extended portion 803 from the distal end of the rear-most point of the base portion 802 to the distal end of the rear-most portion of the extended portion may be about 3 inches The expanded version of the "French Flash Fall" depicted in FIG. 9B may be employed, for example, where a larger area of coverage is desired, as where, for example, a user may have a larger head and/or a more extensive area of thinning hair that must be covered. The larger dimensions of the hair piece of FIG. 9B, as compared to the hair piece of FIG. 9A, accommodates larger heads and/or more expansive areas of thinning hair.

In addition to providing anti-slip properties, the ant-slip strips 804 illustrated in the various embodiments also serve to provide cushioning and support.

Figure 10:
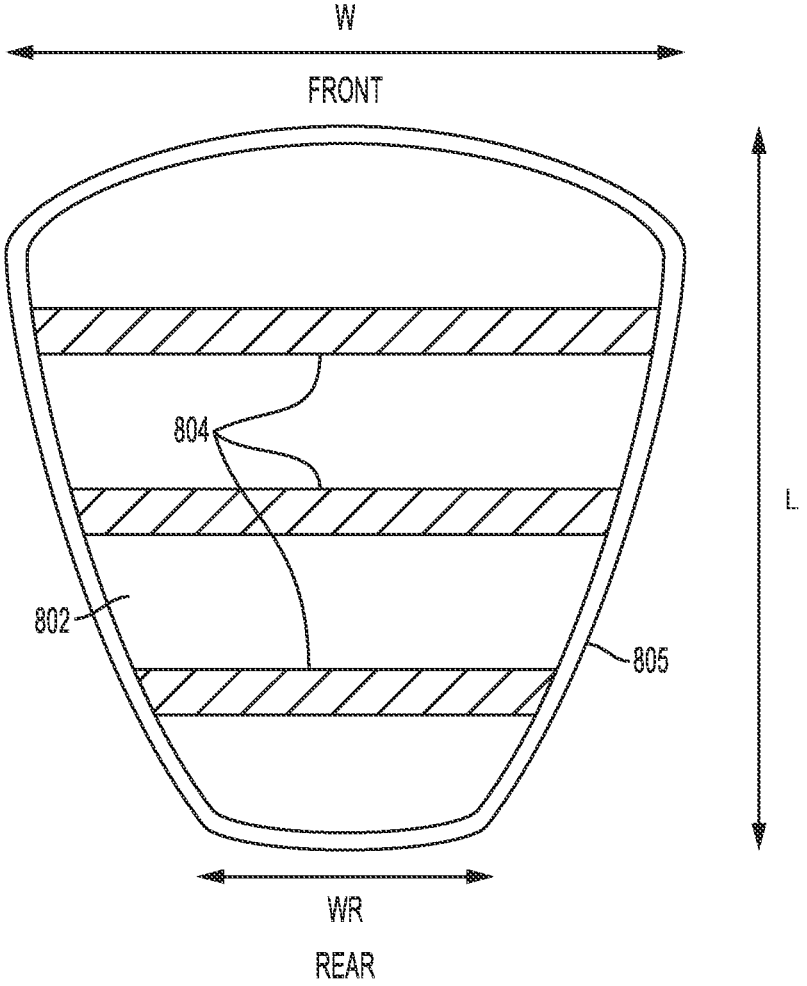
FIG. 10 illustrates another hair piece style in accordance aspects of the present disclosure.

Adverting to FIG. 10, a hair piece, which may be identified, for example, as a "French Bang," is illustrated. In this style, there is a perimeter 805 that may be made of 0.125 inch folded Swiss lace, surrounding the entire hair piece. The hair piece of FIG. 10 has a substantially escutcheon shape. A front portion of the hair piece preferably has a convex shape, bulging in the forward direction. The rear portion of the hair piece is substantially flat in the sense that it is not curved, or has very little curve, when viewed from a top-view. As in the previously described embodiments, there is a plurality of anti-slip strips 804 on the underside of the base portion 802 of the hair piece. The hair piece comprises a top that may be made of silk, e.g., French silk, with a shape providing for a wider front portion and a narrower rear portion. In an exemplary embodiment, the hair piece of FIG. 10 may have a rear portion width WR ranging from 1 to 2 inches, such as 1.5 inches, and the front portion may have a width W ranging from 3 to 4 inches, such as 3.875 inches. The hair piece may have a length of about 4 inches. These dimensions provide for an almost universal fit for most head sizes, with the wider front portion providing for bangs. As previously mentioned, the hair piece of FIG. 10 also provides for a perimeter of 0.125 inch folded lace, such as Swiss lace, the lace acting to provide a natural hairline heavily undervented to camouflage the edge of the hairline, for a more natural look to the enhancement hair piece.

As with the other embodiments, the hair piece illustrated in FIG. 10 also provides for a plurality of anti-slip strips 804, e.g., three, on the underside of the hair piece, to provide cushioning, support, and anti-slip properties.

Figure 11:
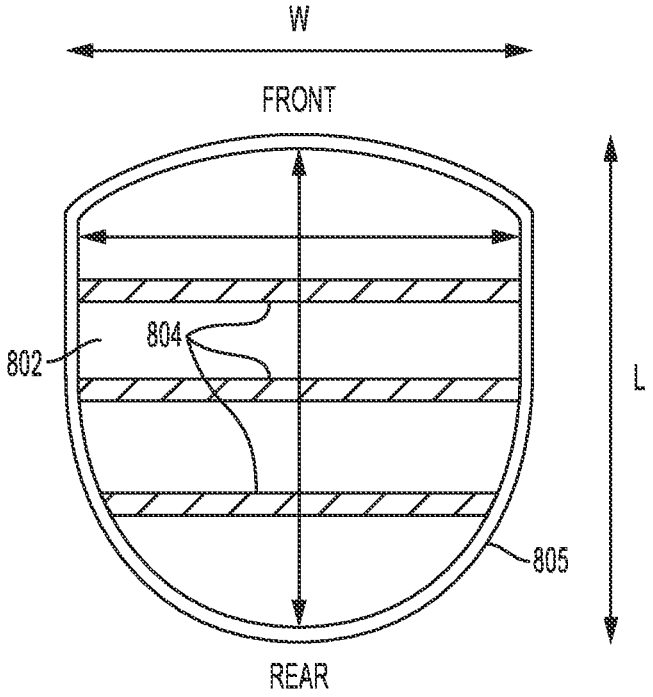
FIG. 11 illustrates still another hair piece style in accordance with aspects of the present invention.

Adverting to FIG. 11, a hair piece, which may be identified, for example, as a "French Flash Partial," is illustrated. In this style, there is a perimeter 805 that is, preferably made of 0.125 inch folded Swiss lace, surrounding the entire hair piece. As in the previously described embodiments, there is a plurality of anti-slip strips 804 on the underside of the base portion 802 of the hair piece. The hair piece comprises a top made of, e.g., silk, such as French silk, with a shape providing for a wider front portion and a narrower rear portion. For example, the hair piece of FIG. 11 may have a widest width W ranging from 2 to 4 inches, e.g., 3.5 inches. The front portion of the hair piece is slightly curved, with the rear portion having a more pronounced curve. The hair piece may have a length of about 3.75 inches. These dimensions provide for spot coverage and/or volume, and a versatile middle top placement. The hair piece of FIG. 11 may also have a perimeter 805 of, for example, about 0.125 inch folded lace, such as Swiss lace, the lace acting to provide a natural hairline heavily undervented to camouflage the edge of the hairline, for a more natural look to the enhancement hair piece.

As with the other embodiments, the hair piece illustrated in FIG. 11 may also provides for a plurality of anti-slip strips 804, e.g., three, on the underside of the hair piece, to provide cushioning, support, and anti-slip properties.

Figure 12:
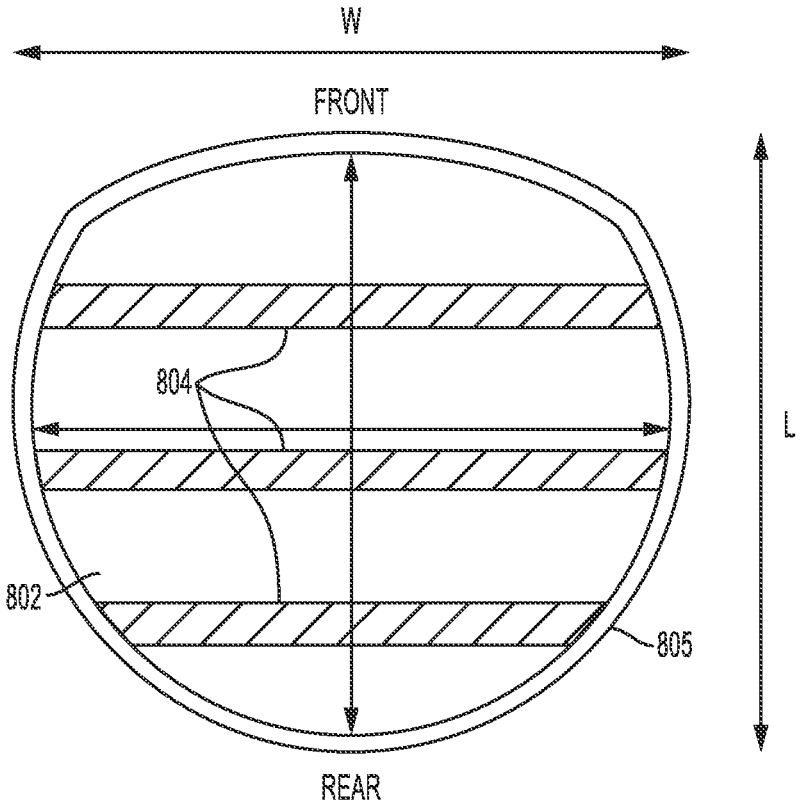
FIG. 12 illustrates yet another hair piece style in accordance with aspects of the present disclosure.

Adverting to FIG. 12, a hair piece, which may be identified, for example, as a "French Crown," is illustrated. In this style, there is a perimeter 805 that may be made of 0.125 inch folded Swiss lace, surrounding the entire hair piece. As in the previously described embodiments, there is a plurality of anti-slip strips 804 on the underside of the base portion 802 of the hair piece. The hair piece comprises a top surface, which may be made of silk, such as French silk, with a shape providing for a slightly curved front portion and a more circular-curved rear portion. For example, the hair piece of FIG. 12 may have a widest width W ranging from 2 to 4 inches, e.g., 3.75 inches. The hair piece may have a length of about 3.5 inches. These dimensions provide for target coverage and/or volume or length for the crown area of the head. The hair piece of FIG. 12 may also provide for a perimeter 805, such as of 0.125 inch folded lace, e.g., Swiss lace, the lace acting to provide a natural hairline heavily undervented to camouflage the edge of the hairline, for a more natural look to the enhancement hair piece.

The hairpiece of FIG. 12 also provides for a plurality of anti-slip strips 804, e.g., three, on the underside of the hair piece, to provide cushioning, support, and anti-slip properties.

The "French Crown" style illustrated in FIG. 12 should have the same natural soft curve that the crown of the user's head has. The "French Crown" style finds particular use in situations, for example, radiation, chemical burns, alopecia areata, environment disease, post hair transplantation, androgenetic alopecia, and trichotillomania, and may provide for volume, lift, fullness, fill-in for kallicks and splits in the crown, increased stylability, reduced styling and preparation time. This style may also provide, as with the other described styles, aspects for a younger look, a finish style profile, sociability, and may be used for special occasions.

The embodiments of the present disclosure can achieve several technical effects, such as, for example, a hair piece having characteristics of seamless, light, breathable, durable, and realistic. The present disclosure enjoys industrial applicability in any of various types of uses to attach (human, artificial, animal, etc.) hair, particularly when used as a hair piece (e.g., wig, toupée, etc.).

In the preceding description, the present disclosure is described with reference to specifically exemplary embodiments thereof. It will, however, be evident that various modifications and changes may be made thereto without departing from the broader spirit and scope of the present disclosure, as set forth in the claims. The specification and drawings are, accordingly, to be regarded as illustrative and not as restrictive. It is understood that the present disclosure is capable of using various other combinations and embodiments and is capable of any changes or modifications within the scope of the inventive concept as expressed herein.

What is claimed is:

1. A hair product comprising:

a first layer;

a second layer having a lace open weave structure;

a third layer, the first and third layers encasing the second layer; and a plurality of strands of hair, each of the plurality of strands of hair being affixed to the second layer and extending therefrom, wherein the hair product has a substantially escutcheon shape having a forward portion and a rear portion, the forward portion having a convex shape bulging in a forward direction, and the rear portion being substantially flat and having a width less than the width of the forward portion, and wherein the second layer is longer than the first layer and the third layer.

2. The hair product according to claim 1, wherein the hair product has a longest length of about 4 inches from an edge of the front portion to an edge of the rear portion, the front portion has a width of about 3.875 inches; and the rear portion has a width of about 1.5 inches.

3. The hair product according to claim 1, further comprising a folded lace around the perimeter of the hair product.

4. The hair product according to claim 3, wherein the folded lace perimeter has a thickness of about 0.125 inches.

5. The hair product according to claim 1, further comprising a plurality of spaced-apart anti-slip strips attached to an underside of the third layer.

6. The hair product according to claim 5, wherein each of the anti-slip strips has a width of about 0.25 inches.

7. The hair product according to claim 5, wherein the number of spaced-apart anti-slip strips is three.

8. The hair product according to claim 1, wherein the front portion corresponds to the hairline of a user and the front portion has a natural soft curve to correspond to the hairline.

9. A hair piece comprising:

a base comprising first, second, and third layers, the first and third layers at least partially encasing the second layer;

a plurality of strands of hair extending from the second layer; and an encasement layer at least partially surrounding an outer perimeter of the base, the encasement layer being stitched to the base; wherein the hair piece comprises a front portion and a rear portion, and the encasement layer extends beyond the first and third layers at the rear portion.

10. The hair piece according to claim 9, wherein the hairpiece has a length of about 5.25 inches, the first and third layers each has a length of about 4 inches, and the encasement layer extends about 1 inch from the first and third layers at the rear portion.

11. The hair piece according to claim 10, further comprising folded lace surrounding the perimeter of the hair piece.

12. The hair piece according to claim 11, wherein the folded lace has a thickness of about 0.125 inches.

13. The hair piece according to claim 9, wherein the hairpiece has a length of about 6 inches, the first and third layers each has a length of about 4.25 inches, and the encasement layer extends about 1.5 inches from the first and third layers at the rear portion.

14. The hair piece according to claim 9, wherein the hair piece has a length of about 3.5 inches and a width of about 3.25 inches at its widest portion.

15. The hair piece according to claim 9, wherein the hair piece has a length of about 4.5 inches and a width of about 3 inches at its widest portion.

16. The hair piece according to claim 9, wherein the hair piece has a natural soft curve corresponding to the crown of a user, the hair piece having a length of about 3.5 inches and a width of about 3.75 inches.

17. The hair piece according to claim 9, wherein the hair piece has a length of about 5.675 inches, the first and third layers each has a length of about 4 inches, and the encasement layer extends about 1.5 inches from the first and third layers at the rear portion.

18. The hair piece according to claim 9, wherein the hair piece has a length of about 8.125 inches, the first and third layers each has a length of about 5 inches, and the encasement layer extends about 3 inches from the first and third layers at the rear portion, a portion of the encasement layer contacting and partially surrounding the first and third layers except at a front edge of the first and third layers corresponding to the front portion of the hair piece.

19. The hair product according to claim 9, wherein the first, second, and third layers comprise a square front portion having rounded corners and a round back portion.

* * * * *